US011547170B2

(12) United States Patent
Lacy et al.

(10) Patent No.: US 11,547,170 B2
(45) Date of Patent: Jan. 10, 2023

(54) BREAKAWAY CLASP FOR HEADWEAR

(71) Applicant: Sunday Afternoons, Inc., Talent, OR (US)

(72) Inventors: Robbin Lacy, Talent, OR (US); Joey Fallon, Ashland, OR (US); Russell Hodgdon, Talent, OR (US); Joey Zachariasen, Talent, OR (US)

(73) Assignee: Sunday Afternoons, Inc., Talent, OR (US)

( * ) Notice: Subject to any disclaimer, the term of this patent is extended or adjusted under 35 U.S.C. 154(b) by 318 days.

(21) Appl. No.: 15/931,489

(22) Filed: May 13, 2020

(65) Prior Publication Data

US 2020/0268091 A1 Aug. 27, 2020

Related U.S. Application Data

(63) Continuation-in-part of application No. 16/570,999, filed on Sep. 13, 2019, which is a continuation of application No. 15/382,455, filed on Dec. 16, 2016, now Pat. No. 10,448,694.

(60) Provisional application No. 62/269,722, filed on Dec. 18, 2015.

(51) Int. Cl.

| | |
|---|---|
| ***A44B 11/04*** | (2006.01) |
| ***A42B 7/00*** | (2006.01) |
| ***A42B 1/02*** | (2006.01) |

(52) U.S. Cl.

CPC ..... *A42B 7/00* (2013.01); *A42B 1/02* (2013.01); *A44B 11/04* (2013.01)

(58) Field of Classification Search

CPC .. A41F 1/006; Y10T 24/4091; Y10T 24/4093; Y10T 24/3403; Y10T 24/344; Y10T 24/3431; A44B 11/04

See application file for complete search history.

(56) References Cited

U.S. PATENT DOCUMENTS

| | | | | |
|---|---|---|---|---|
| 745,884 | A * | 12/1903 | Morton | A44B 11/04 24/198 |
| 2,039,174 | A | 4/1936 | Lewis | |
| 2,140,164 | A * | 12/1938 | Moffatt | A41F 1/006 24/200 |
| 5,177,837 | A | 1/1993 | Rekuc | |
| 5,930,841 | A | 8/1999 | Lampe et al. | |
| 6,435,940 | B1 * | 8/2002 | Fildan | A41F 1/006 450/86 |

(Continued)

*Primary Examiner* — Robert Sandy

(74) *Attorney, Agent, or Firm* — McCoy Russell LLP

(57) ABSTRACT

Embodiments are disclosed for a clasp configured to accommodate a strap of a piece of headwear, including a top loop having a catch end at a first side of the clasp, the top loop including a top portion that extends from a second side of the clasp to the first side along a horizontal axis of the clasp, the catch end extending from the top portion along an s-shaped curve to form a tip of the catch end; a bottom loop coupled to the top loop via a common middle portion, a top surface of the common middle portion having a lip; and a depression at the top loop on the second side, a thinnest part of the top loop at the second side of the clasp being formed by the depression.

19 Claims, 9 Drawing Sheets
(7 of 9 Drawing Sheet(s) Filed in Color)

(56) References Cited

U.S. PATENT DOCUMENTS

| | | | | |
|---|---|---|---|---|
| 7,234,995 | B2 * | 6/2007 | Fildan | A44B 11/04 24/265 AL |
| 2008/0155792 | A1 * | 7/2008 | Yeh | A44B 11/04 24/169 |

* cited by examiner

BREAKAWAY CLASP FOR HEADWEAR

CROSS-REFERENCE TO RELATED APPLICATIONS

The present application is a continuation-in-part of U.S. patent application Ser. No. 16/570,999, entitled "BREAKAWAY CLASP FOR HEADWEAR", and filed on Sep. 13, 2019. U.S. patent application Ser. No. 16/570,999 is a continuation of U.S. patent application Ser. No. 15/382,455, entitled "BREAKAWAY CLASP FOR HEADWEAR", and filed on Dec. 16, 2016. U.S. patent application Ser. No. 15/382,455 claims priority to U.S. Provisional Patent Application No. 62/269,722, entitled "BREAKAWAY CLASP FOR HEADWEAR", and filed on Dec. 18, 2015. The entire contents of each of the above-identified applications are hereby incorporated by reference for all purposes.

FIELD

The disclosure relates to headwear or other accessories including a breakaway clasp.

BACKGROUND

Headwear, such as wide-brimmed hats, may include chin straps to secure the hat on a user's head and/or allow the hat to hang on a user's back. While chin straps may be adjustable to change a tightness around the user's chin/neck, some chin straps may be attached to the hat in a permanent or semi-permanent manner (e.g., via stitching, gluing, and/or other coupling mechanisms).

SUMMARY

Embodiments are disclosed for a clasp configured to accommodate a strap of a piece of headwear. In an example, the clasp includes a top loop having a catch end at a first side of the clasp, the top loop including a top portion that extends from a second side of the clasp to the first side along a horizontal axis of the clasp, the catch end extending from the top portion along an s-shaped curve to form a tip of the catch end; a bottom loop coupled to the top loop via a common middle portion, a top surface of the common middle portion having a lip; and a depression at the top loop on the second side, a thinnest part of the top loop at the second side of the clasp being formed by the depression.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The disclosure may be better understood from reading the following description of non-limiting embodiments, with reference to the attached drawings, wherein below.

DETAILED DESCRIPTION

As described above, headwear may include mechanisms for securing to a wearer's head and/or to otherwise prevent the headwear from being removed from the wearer. For example, a chin strap may extend from one location of a crown or brim of a hat, around a wearer's jaw/chin, and back to an opposing location of the crown or brim of the hat. In this way, if wind, rain, or another strong force pushes the hat backward off of the wearer's head, the chin strap may catch on the wearer's chin or neck, preventing the hat from flying off of the wearer entirely. The chin strap may also be tightened under the wearer's chin in order to ensure that the hat remains at a desired position on the wearer's head in the presence of weaker forces.

While the above-described chin strap or other securing mechanism may help prevent headwear from being knocked off of a wearer, there may be situations where the wearer may prefer a quick-release option (e.g., in the presence of very strong forces or when the strap becomes uncomfortable). For example, the quick-release option may provide a safety feature to allow the strap to become unclasped in the presence of excess forces (e.g., if the chin strap is caught on a wearer's neck and exerting uncomfortable forces thereon). The quick-release option may also allow a parent to quickly and easily release the headwear from a child who no longer desires to wear the headwear or who is experiencing discomfort with the headwear. The disclosure provides a breakaway clasp that maintains structural integrity to secure headwear under a first range of forces and/or forces at a first range of angles, and breaks away under a second, higher range of forces and/or forces at a second range of angles. For example, the range of forces at which the clasp maintains structural integrity may be different for different angles at which such forces are applied. While the examples described herein will largely be presented with respect to a chin strap or other headwear securing mechanism for illustrative purposes, it is to be understood that the described features may be utilized for a clasp in any environment. For example, the clasps described herein may be included in a belt, harness, band (e.g., watch band, head band, etc.), and/or other suitable product without departing from the scope of this disclosure.

Figure 1:
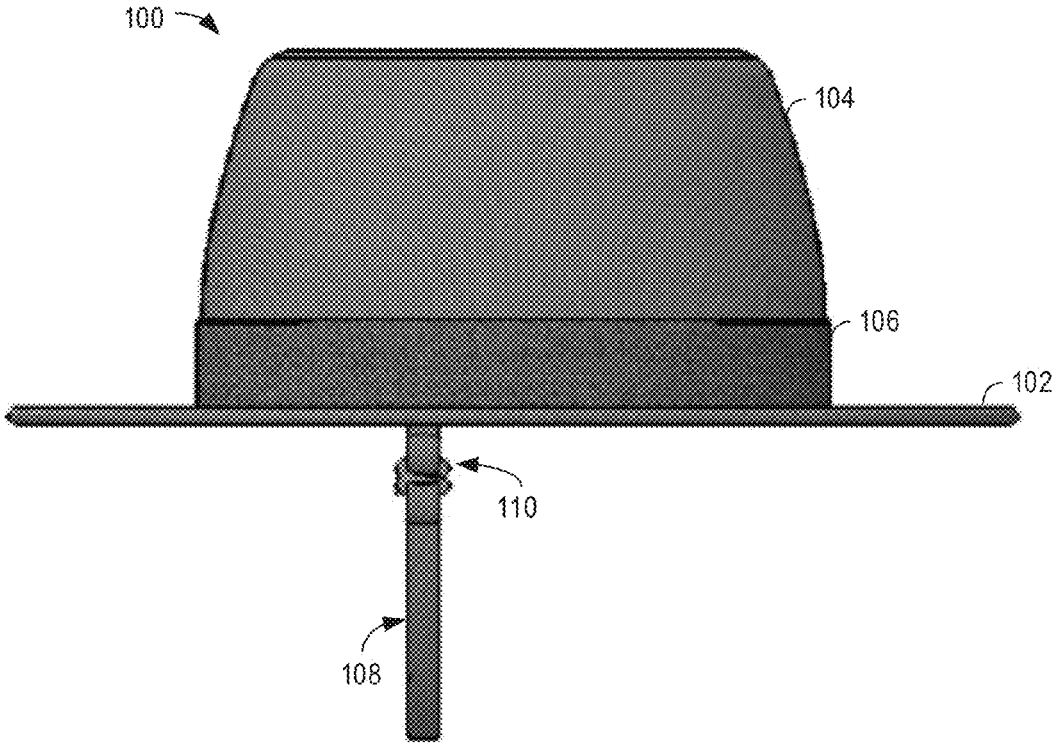
FIG. 1 shows a side view of an example headwear including a clasp in accordance with one or more embodiments of the present disclosure.

FIG. 1 shows a side view of an example headwear, such as a hat 100. As illustrated, headwear 100 includes a brim 102 and a crown 104. The brim 102 may be attached to, extend from, and/or otherwise be carried by the crown 104 (e.g., a bottom portion of the crown 104). The crown may comprise a cap configured to extend over a top of a wearer's head. In some embodiments, the crown 104 may include a plurality of panels extending around a circumference of the crown and intersecting at a central region. In other embodiments the crown 104 may be formed of a single panel or piece of fabric (e.g., a unibody construction) forming any suitable hat body shape. In some embodiments, each panel (or the entirety of the crown/visor) may include the same type of fabric or other material. In other embodiments, one or more panels (or the crown) may include a different type of material than the other panels (or the visor). As illustrated in FIG. 1, the crown may include one or more external peripherals, such as band 106, which may serve aesthetic and/or utility (e.g., providing a tightening mechanism to assist in securing the hat to a wearer's head) purposes.

A chin strap 108 may extend from the brim 102 and/or the crown 104. For example, the chin strap 108 may be integrated with and/or coupled/attached to a bottom surface of the brim 102, an interior surface of the crown 104, an intersection at which the brim and crown meet, and/or any other suitable location. As the brim and/or crown of the hat 100 forms a substantially circular structure, the chin strap may be coupled and/or attached to the hat at two positions along a circumference of the crown and/or brim. For example, a first position or location at which the chin strap is coupled and/or attached to the hat may be directly opposite a second position or location at which the chin strap is coupled and/or attached to the hat (e.g., approximately 180 degrees separating the two locations/positions). As used herein, the terms secured to, coupled to, and/or attached to may encompass any suitable securing mechanism, including but not limited to stitching, gluing, grommets, magnets, and/or any other suitable mechanical or chemical fastening mechanism.

In other examples, the two positions or locations may be on opposite sides of the hat (e.g., such that the positions are on opposite sides of a wearer's head/face while the hat is worn), and not 180 degrees apart. For example, the two positions or locations may be positioned toward a rear of the hat, and separated by less than 180 degrees (e.g., within a range of 30 to 179 degrees) when measured across the rear of the hat. As another example, the two positions or locations may be positioned toward a front of the hat, and separated by less than 180 degrees (e.g., within a range of 30 to 179 degrees) when measured across the front of the hat. As used herein, the terms opposing positions or opposing locations may refer to any of the example positions described above.

Figure 2:
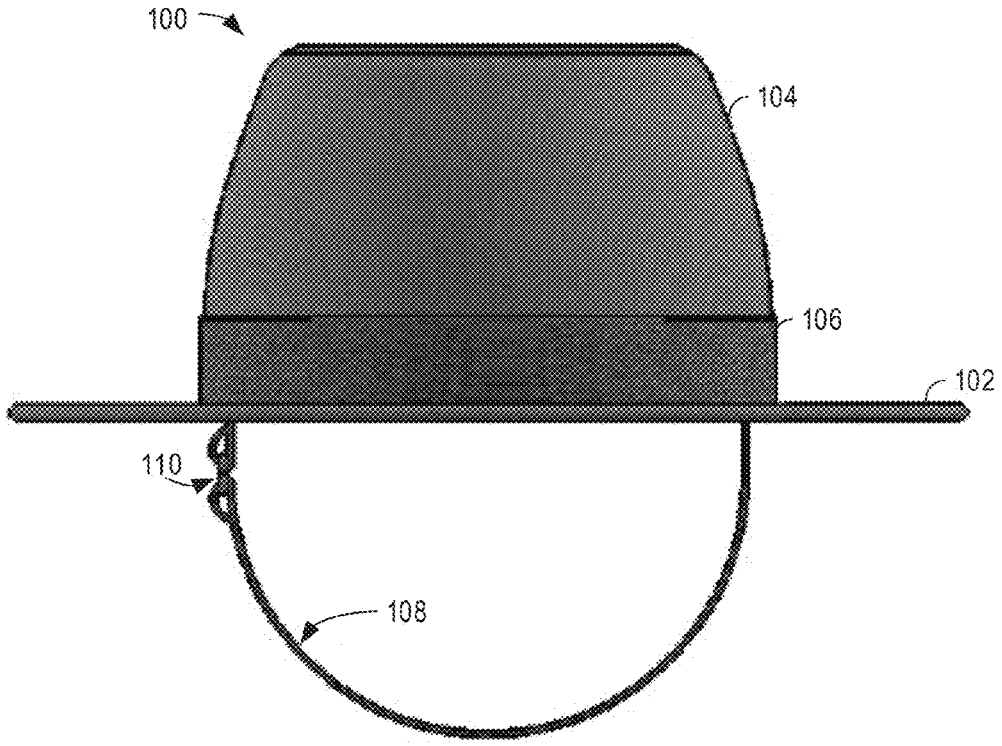
FIG. 2 shows a front view of the example headwear of FIG. 1 in accordance with one or more embodiments of the present disclosure.

The chin strap 108 may include a single strap of material (e.g., a same material as used in another region of the hat, an elastomeric material, a fabric and/or self-fabric, a cord or collection of cording, a string or collection of strings, lacing, and/or another suitable material or composite material) that is interrupted by a clasp 110 and/or two strap portions of material that are joined via the clasp 110. In the two strap portions example, each strap portion may include two terminal ends opposite one another along a longitudinal axis of the strap portion (e.g., along a length/longest dimension of the strap portion). A first terminal end of each strap portion may be coupled and/or attached to a different one of the two opposing locations along the circumference of the brim/crown. A second terminal end of each strap portion may be coupled and/or attached to the clasp 110. For example, the second terminal ends of the strap portions may include a loop of fabric. The clasp 110 may include two loops, one or both of which may be closed and one or both of which may be open. The loop of fabric at each of the second terminal ends of the strap portions may enclose a top or bottom portion of a respective one of the loops of the clasp 110. An example of this construction is shown in FIG. 2, which illustrates a front view of hat 100 of FIG. 1. In an example where at least one of the loops of the clasp 110 is open, the wearer may freely insert or remove the top/bottom portion of that loop (e.g., a leg forming a top or bottom surface of the loop) into an opening within the loop of a respective terminal end of one of the strap portions of the chin strap 108. The connection of the straps to the clasp will be described in more detail below with respect to FIG. 4.

In the single strap example, the strap may include two terminal ends, each of which is coupled and/or attached to the above-described opposing locations along a circumference of the brim and/or crown. In such an example, the clasp may include two closed loops joining two sections of the strap, such that a wearer may not be able to separate the two sections of the strap without applying enough force to break the clasp. In another embodiment of the single strap example, the strap may include two terminal ends, one or both of which is either 1) coupled and/or attached to the above-described opposing locations along the circumference of the brim and/or crown, or 2) coupled and/or attached to a loop of fabric, metal, or other material that is coupled and/or attached to the above-described opposing locations along the circumference of the brim and/or crown. In this way, only one or none of the terminal ends may extend from the hat directly. In one example, a small sewn loop along the sweatband of the hat may attach directly to a chin strap clip.

Figure 3:
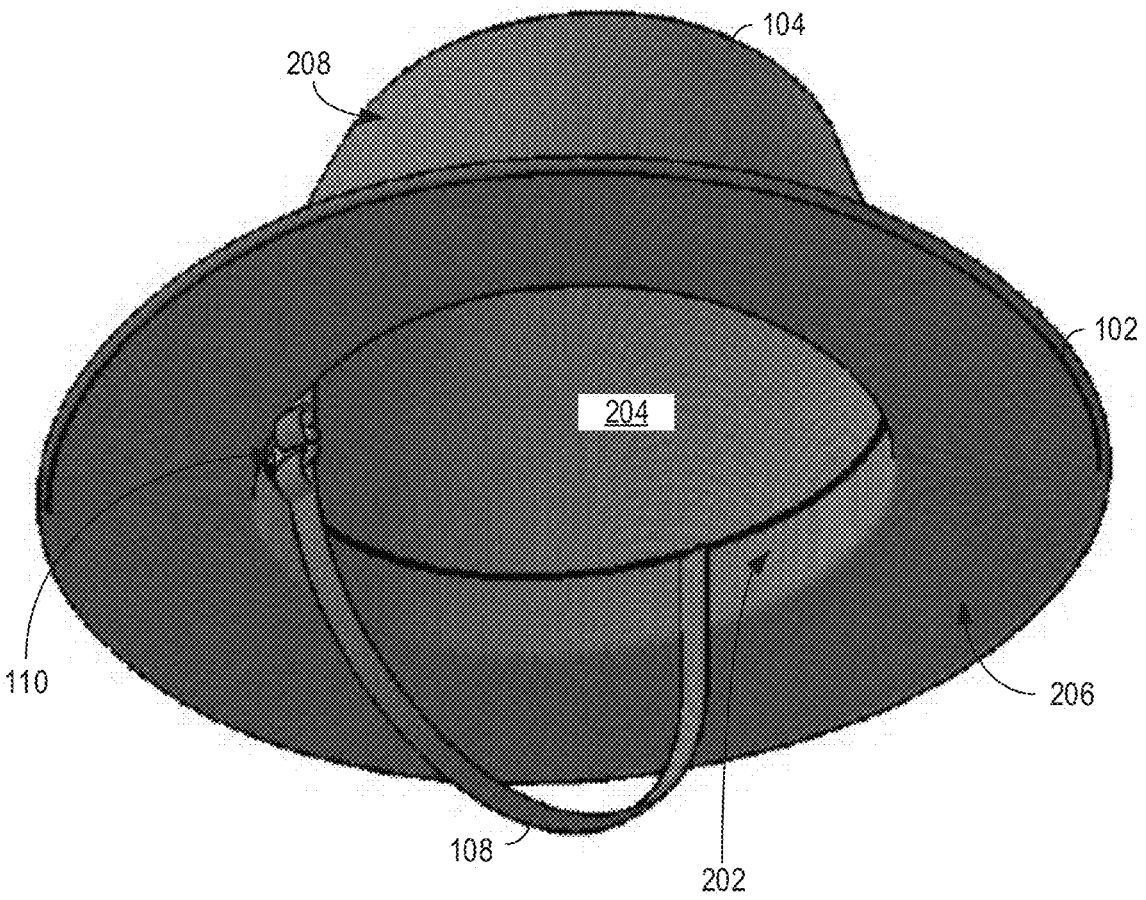
FIG. 3 shows a bottom isometric view of the example headwear of FIG. 1 including a clasp in accordance with one or more embodiments of the present disclosure.

A headband (illustrated in FIG. 3, which shows a bottom isometric view of the hat 100) may extend around at least a portion of the circumference of the crown 104 (e.g., along a bottom edge of the crown). Turning now to FIG. 3, a headband 202 and an interior of the crown 104 of headwear 100 of FIG. 1 are shown. The headband 202 may form an extension of the brim 102 and/or a junction between the crown and the brim 102. The headband may extend around at least a portion of the circumference and/or perimeter of the base of the crown. For example, headband 202 may be formed from a substantially rectangular panel that is continuous around the circumference of the crown and/or that includes terminating ends that are joined to or spaced from one another.

In the example illustrated in FIG. 3, terminal ends of the chin strap 108 are coupled and/or attached to the hat at an interior region of the crown 104. For example, the terminal ends may be coupled and/or attached to a junction between the headband 202 and an interior surface 204 of the crown 104. In some examples, the terminal ends may be sandwiched between an interior (e.g., crown-facing) surface of the headband 202 and the interior surface 204 of the crown 104. In other examples, the terminal ends may be directed coupled and/or attached to the interior surface 204 of the crown 104, the headband 202, and/or a bottom surface 206 of the brim 102. In still other examples, the terminal ends may pass through the brim 102 and/or crown 104. For example, the terminal ends may be secured to an outer surface 208 of the crown and pass through respective holes in the brim 102 and/or crown 104 to extend around a chin of the wearer.

Although illustrated as a wide-brimmed hat (e.g., with a brim that extends from/around the full circumference of the crown/hat), it is to be understood that the clasp described herein may be utilized and/or incorporated in any suitable hat or other item, such as a baseball-style cap, a visor (e.g., without a crown), a sun hat (e.g., with a wide brim and/or a partial brim that extends around a portion of the circumference of the crown/hat and may include a neck shield extending from a rear portion of the circumference of the crown/hat), a wristband, a belt, a band for an article of clothing (e.g., an adjustable band around a pant leg/gaiter), etc. Other examples of hats in which the features described herein may be incorporated include, without limitation, a charter hat, a sun fedora, a boonie hat, a capotain, a gat, a hardee hat, a homburg, a panama, a sombrero, a sun visor, a top hat, a legionnaire hat, a trilby, a flap hat, and/or any other suitable head covering.

Although illustrated and described as being used with a chin strap in some of the above examples, it is to be understood that the clasp described herein may be utilized for any purpose relating to joining, connecting, coupling, and/or otherwise coordinating portions of a hat or other article of clothing. For example, the clasp described herein may be included in a sizing mechanism. In such an example, the clasp and/or material to which the clasp is connected may extend at least partially around the circumference of a hat and affix to a loop for sizing the hat.

Figure 4:
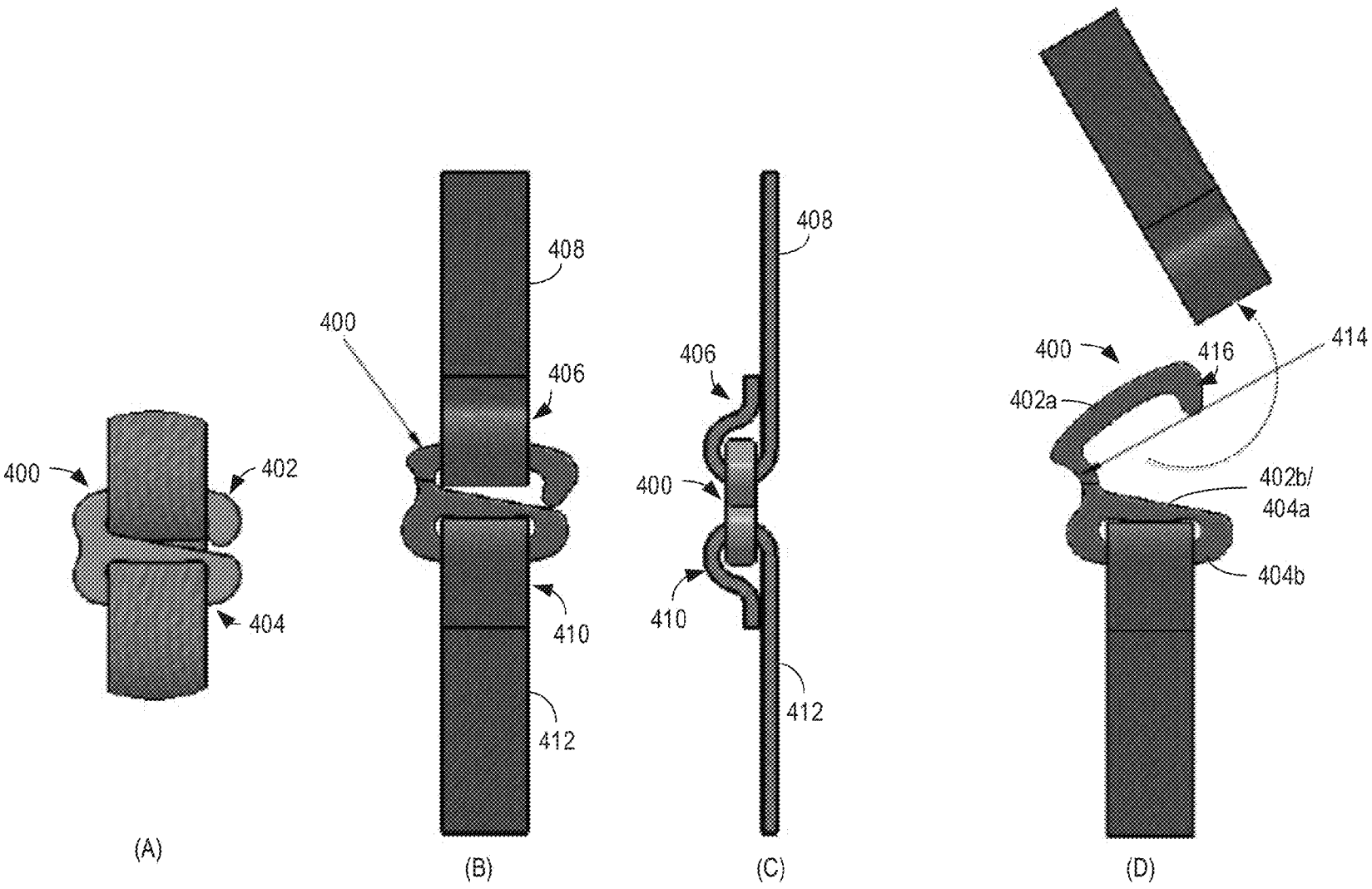
FIG. 4 shows a detailed view of an example clasp in different orientations and states in accordance with one or more embodiments of the present disclosure.

FIG. 4 shows a detailed view of an example clasp 400 in different orientations and states, labelled as views A-D. Clasp 400 may be an example configuration of clasp 110 of FIGS. 1-3. View A is a front view of clasp 400, including an open top loop 402 and a closed bottom loop 404. For example, top loop 402 may be open in that a top leg 402*a* of the loop is at least partially spaced from a bottom leg 402*b* of the loop during a clasping operation in order to allow for insertion into a loop of a terminal end 406 of a first strap 408 of a chin strap (e.g., chin strap 108 of FIGS. 1-3). Bottom loop 404 may be closed in that top leg 404*a* (e.g., which may also serve as bottom leg 402*b* of the top loop 402) is continuously and/or integrally formed with bottom leg 404*b* to form an anchor for the chain strap/clasp. The bottom loop 404 may be sized based on the material used for the chin strap and/or for the clasp, and/or based on an application of the clasp (e.g., whether it is used in a child's hat or an adult's hat). In order to couple a loop of a terminal end 410 of a second strap 412 into this bottom loop 404, the terminal end 410 may be passed through the opening of loop 404, then secured back onto itself, forming the illustrated strap loop. Accordingly, in use, a wearer may only clasp the chin strap through insertion of the clasp into one of the terminal end loops, whereas the other of the terminal end loops may be substantially permanently attached to the clasp.

While view A shows a front view of the clasp 400 where the spaced-apart legs of the top loop 402 during insertion of the clasp into the terminal end of the strap, view B shows a rear view of the clasp 400 after the clasp leg has been inserted into the terminal end and the legs of the top loop 402 are adjacent one another. In some examples, the spaced-apart legs may be ever-present in order to increase ease of insertion/removal of the clasp leg into the terminal end of the strap. In other examples, the adjacent legs illustrated in view B may be achieved via an elastomeric material or region of the clasp in order to provide additional security of the terminal end within the loop of the clasp.

View C shows a side view of the clasp 400 and the inserted terminal ends 406 and 410 of straps 408 and 412, respectively. As shown, the looped terminal ends are formed by attaching the terminal end to a higher/lower point along the strap. In some examples, one or both of the straps may be adjustable by moving the location at which the terminal end(s) attach back to the strap. For example, the chin strap may be tightened by pulling the terminal end of strap 408 upward (when the strap is in the orientation illustrated in view C) and/or toward the crown of the hat/toward a top of the wearer's head. The chin strap may additionally or alternatively be tightened by pulling the terminal end of strap 412 downward (when the strap is in the orientation illustrated in view C) and/or away from the crown of the hat/toward the wearer's feet (or around the wearer's chin toward an opposite side of the hat).

View D shows a breakaway state of the clasp 400. For example, responsive to a threshold amount and/or angle of force placed on the clasp and/or on the straps relative to one another, the clasp may be configured to separate in order to release the chin strap. As illustrated in view D, the bottom loop 404 of the clasp 400 may stay substantially unchanged in the face of such forces. However, the top leg 402*a* of the top loop 402 may be rotated and pulled away from the bottom leg 402*b* of the top loop 402 (e.g., at a hinge 414 opposite hook 416) in order to allow the strap 408 to be released from the clasp. The hinge 414 may be configured to be resilient to different amounts and/or angles of force based on an application of the clasp (e.g., a type of hat being worn, a type of wearer of the hat, an activity in which the hat is being worn, a location of the chin strap, a type of article including the clasp [e.g., other than a hat], etc.). For example, the clasp may be composed of different material types and/or have different dimensions that is based on typical forces that are applied to the objects being joined by the clasp. In the illustrated example, the clasp joins two portions of a chin strap, so the clasp may be dimensioned (e.g., include certain relative thickness and/or types of materials in particular regions) to enable the clasp to resiliently bend or twist responsive to a range of forces and force directions associated with normal disconnections of the strap (e.g., to twist the hook to allow the terminal end 406 to be slid off of the hook), and to break responsive to a range of forces and force directions associated with other disconnections of the strap (e.g., movement within a threshold distance of a longitudinal axis of the chin strap when worn). In some examples, the hook 416 may not be present (e.g., the top leg 402 may extend in an inverted c-shape without the illustrated angular change toward the terminal end of the top leg). In additional or alternative examples, the top leg 402 may have an increased or decreased amount of arching in a middle region in order to accommodate different strap types.

Figure 5:
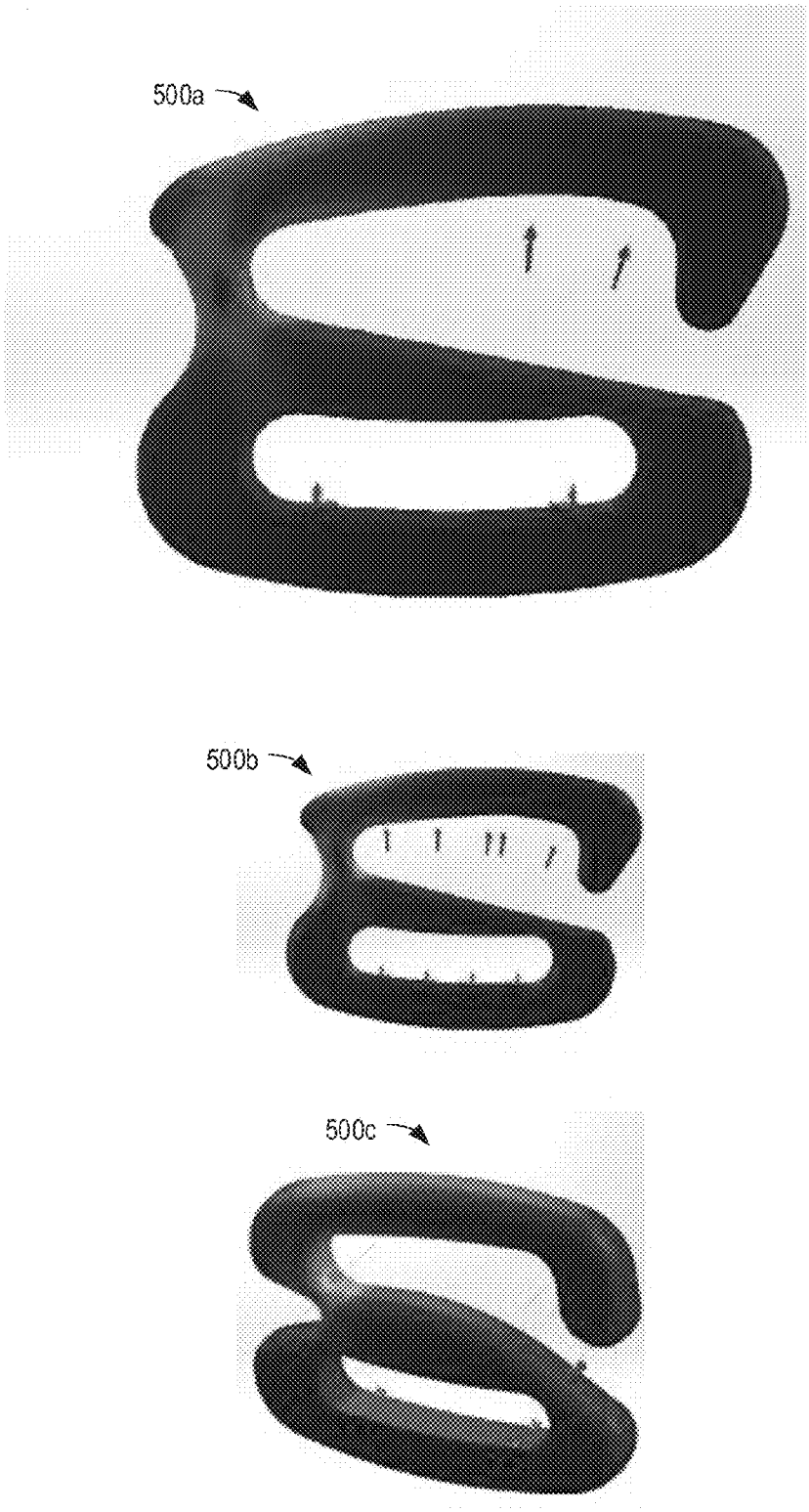
FIG. 5 shows an analysis of the reaction of an example clasp to different forces in accordance with one or more embodiments of the present disclosure.

FIG. 5 shows an analysis of the reaction of an example clasps 500*a*-500*c* to different forces in accordance with one or more embodiments of the present disclosure. For example, clasps 500*a-c* may be examples of clasp 110 of FIGS. 1-3 and/or clasp 400 of FIG. 4. The different colors along the surface of clasps 500*a-c* in FIG. 5 show different levels of breakaway force to which the clasp is configured to withstand. For example, the clasp may provide a lighter or stronger breakaway force depending on the application of the clasp. FIG. 5 shows a finite element analysis (FEA) to determine the reaction (indicated by the different colors) of different regions of the clasp to different forces (indicated by the arrows). The FEA evaluates the strength of material in its form. The analysis may be used to dial in the correct breakaway required for that material and adjust the shape and cross section to match the needs of that specific material. A material similar to Acetal may be used in one example. Additionally or alternatively, additives including but not limited to glass fiber, glass beads, nano tubes, carbon fiber, and/or other materials may be used to attain the targeted strength in a preferred cross section as analyzed by the FEA.

As illustrated in FIG. 5, the blue regions (e.g., the majority of the clasp) are not very susceptible to breaking in the face of the illustrated forces, whereas the green, yellow, and red areas are more susceptible, in that order. Such a differential response to the application of forces may be achieved by forming the clasp of different materials in different regions, as well as by the shape/structure of the clasp, as illustrated. For example, the clasp may be composed of acetal or a similar polymer, such that the plastic clip formed by a top portion of the clasp (e.g., the top leg 402*a* of the clasp 400 in FIG. 4) may break away at predetermined loads based on the angle of the force applied to the clasp. The different thicknesses of material at different regions of the clasp also affect the breakaway patterns and susceptibility, as shown in the different examples of clasps 500*a-c*.

Figure 6:
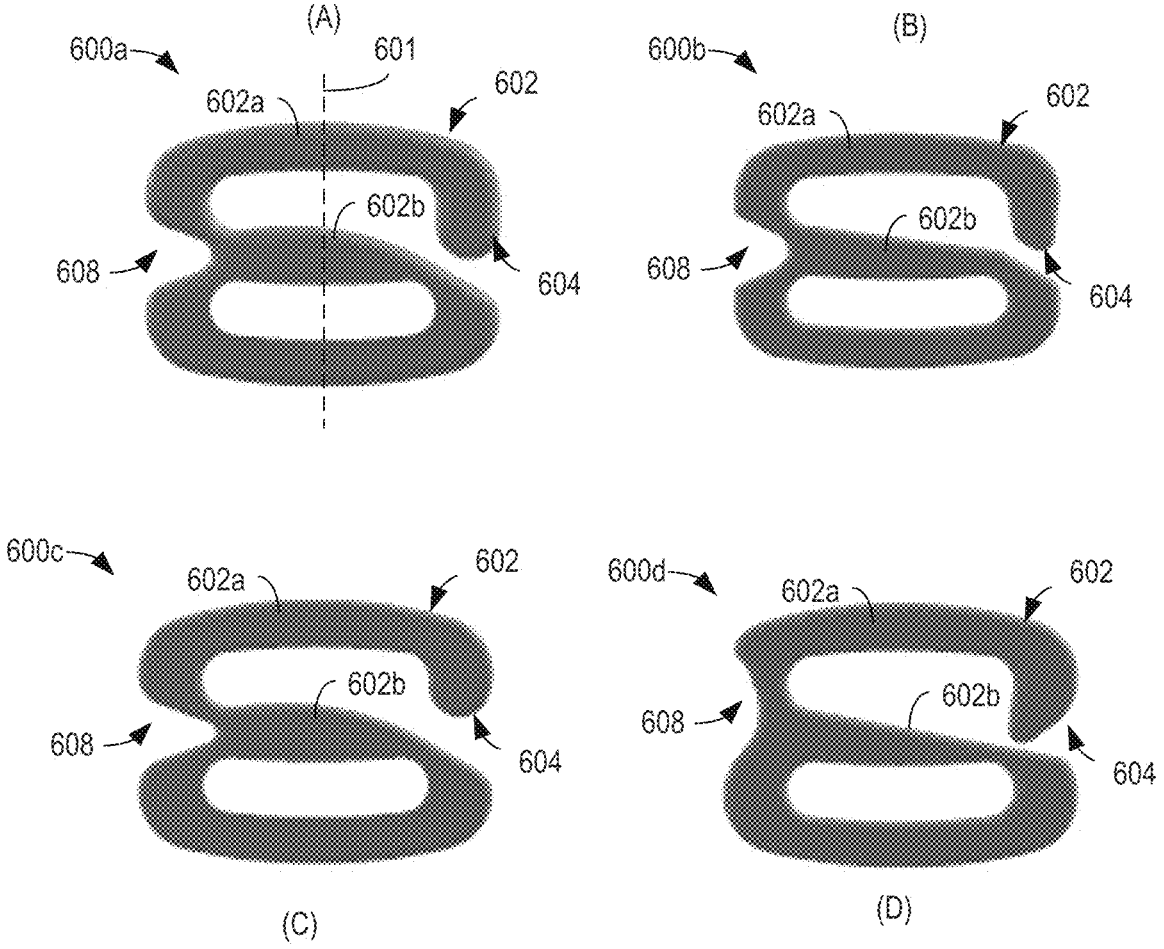
FIG. 6 shows different possible structures for example clasps in accordance with one or more embodiments of the present disclosure.

FIG. 6 shows different possible structures for example clasps 600A-D in accordance with one or more embodiments of the present disclosure. For example, each structure illustrated in FIG. 6 may provide a different breakaway performance (e.g., may breakaway at different ranges of forces and/or for different angles of force) for the S-shaped or Z-shaped clasp having a center axis 601 (only illustrated for 600*a* for clarity purposes). For ease of illustration and reference, similar regions of each different structure will be provided with the same reference numeral, despite having a different shape/configuration. In each of the structures, a ramp including at least a portion of substantially linear declination is provided in a middle region of the clasp. Structures A and C show examples where the middle region (e.g., a bottom leg 602*b* for a top loop 602 of the clasp) is raised in the center (e.g., with an incline, peak, then decline along the upper surface of the bottom leg) and tapers off toward a location of a terminal/spaced end 604 of the respective top leg 602*a* of the top loop 602 of the clasp (e.g., a catch end 604). In structure B, the bottom leg 602*b* has a substantially linear decline along a first portion of the upper surface of the bottom leg, then a sharp increase in the declination upon reaching the location of the terminal/spaced end 604 of the respective top leg 602*a*. In structure C, the bottom leg 602 has a substantially linear declination along the entirety of the top surface.

Other differences between the structures include an inward-facing terminal end 604 of the top leg 602*a*/hook and a shallower depression along the side opposite the terminal end 604 in structure D relative to the other structures. As a result, the thinnest point of a hinge 608 in structure D is higher and further to the side of the clasp than the corresponding points of hinge 608 in structures A-C.

Figure 7:
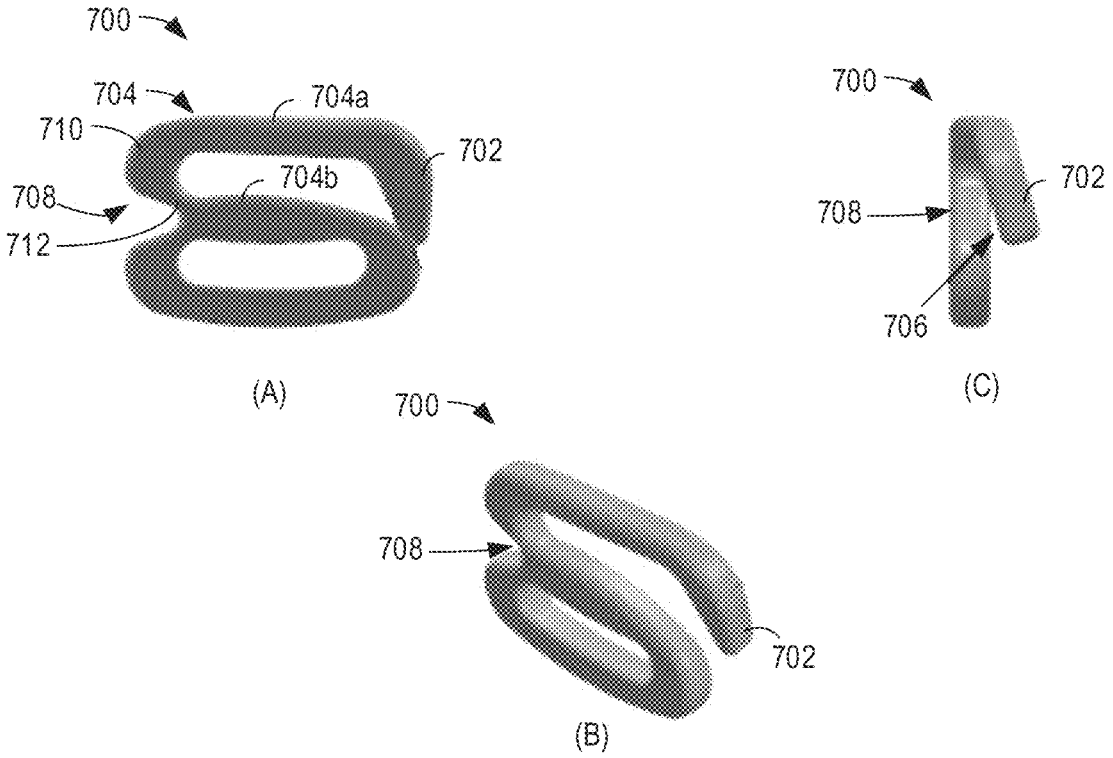
FIG. 7 shows front, isometric, and side views of an example clasp while a force is applied to a region of the clasp in accordance with one or more embodiments of the present disclosure.

FIG. 7 shows front (A), isometric (B), and side (C) views of an example clasp 700 while a force is applied to a region of the clasp in accordance with one or more embodiments of the present disclosure. Clasp 700 may be an example of any of the above-described clasps. As shown, clasp 700 includes an offset hook 702 formed from a top leg 704*a* of a top loop 704 of the clasp. The overlap of the hook over a bottom leg 704*b* of the top loop 704 of the clasp may serve to retain a chin strap therein to avoid unintentional release of the strap. A force applied to the hook 702 may result in the bending or twisting of the hook shown in the side view C. For example, as shown in side view C, a tip 706 of the hook is twisted so as to be unaligned with a hinge 708 or otherwise displayed to the side relative to the top leg 704*a*. In other words, instead of extending straight downward at an approximately right angle from the top leg 704*a* (e.g., from a longitudinal axis of the top leg), the twisting of the hook 702 causes the tip 706 to have a different azimuth relative to a central point of the clasp 700 than in a state at which the hook is not exposed to bending or twisting forces. The tip of the hook may be composed of a material that enables the tip to rotate, twist, or otherwise change azimuth relative to the central point of the clasp to one or more biasable positions (e.g., two or more biasable positions on opposing sides of the hinge 708 responsive to a first range of forces or tension applied to the hook, and to break responsive to a second, higher range of forces applied to the hook. Such an elastic capability may allow a user to displace the hook to allow insertion of a loop of material (e.g., a chin strap terminal end). The hook may be biased to a closed position aligned with the bottom leg 704, such that the hook snaps back to such a position after insertion of the chin strap in order to retain the chin strap therein.

As shown, the hinge 708 may be composed of a thinner material and/or include different material relative to remaining portions of the clasp 700. The top leg 704*a* may extend to the hook 702 at a first terminating end of the top leg, and to a top hinge portion 710 at a second, opposing terminating end of the top leg. The top hinge portion 710 may be thicker (e.g., have a thicker diameter) than a bottom hinge portion 712, and the bottom hinge portion 712 may be thinner (e.g., have a thinner diameter) than the bottom leg 704*b*. In some examples, the bottom hinge portion 712 may include different material than the top hinge portion 710. In additional or alternative examples, one or both of the top and bottom hinge portions 710 and 712 may include the same or different material than remaining areas of the clasp 700.

Figure 8:
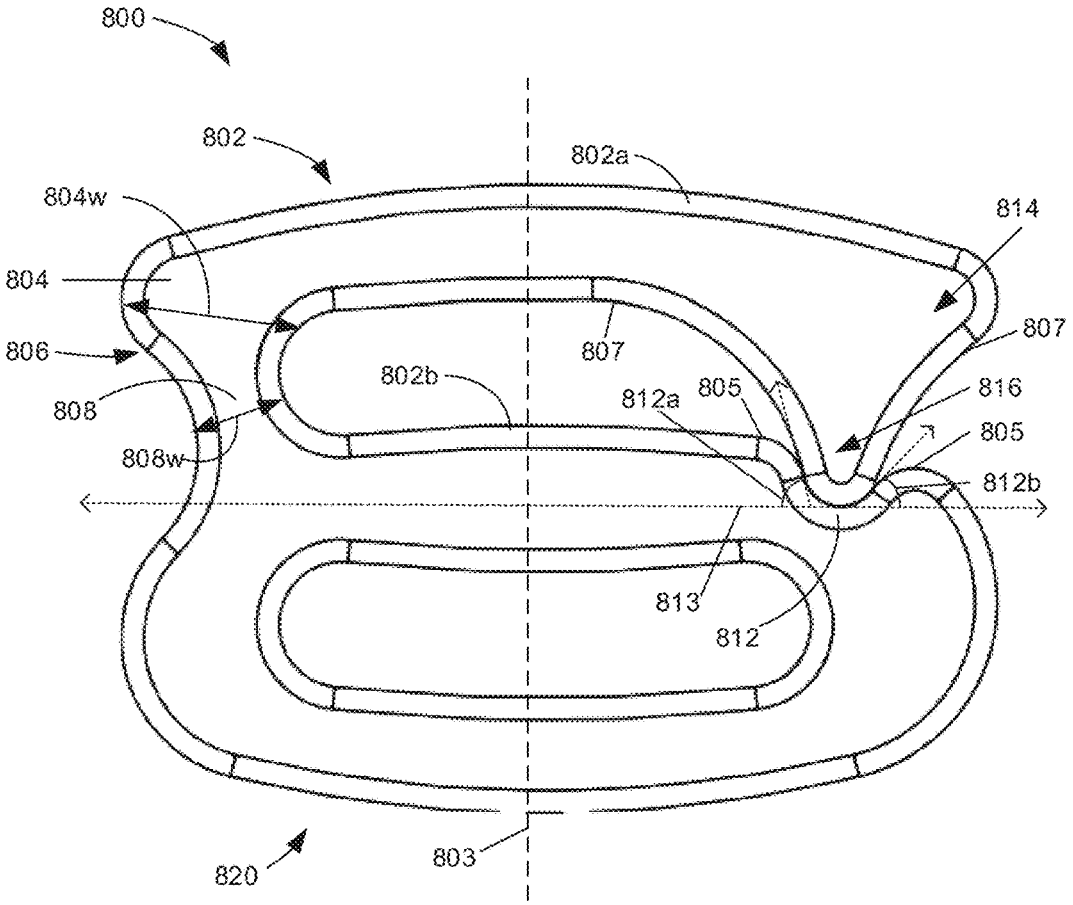
FIG. 8 shows a side view of an example clasp in accordance with one or more embodiments of disclosure.

FIG. 8 shows a side view of an example clasp 800. Clasp 800 is an embodiment of clasp 110 from FIGS. 1-3. As shown, clasp 800 includes a top loop 802 coupled to a bottom loop 820 as defined relative to a horizontal axis 813 (e.g., the top loop 802 is positioned vertically above the horizontal axis 813 and the bottom loop is positioned vertically below the horizontal axis 813), where the top loop 802 and bottom loop 820 share a common middle portion (referred to herein as a bottom leg 802*b* of the top loop 802). A top leg 802*a* of the top loop 802 has a catch end 816 (also referred to as a hook) and a bulge 814 on one side of a parallel axis 803 of clasp 800. The bulge 814 may facilitate user release of the clasp and/or add structural integrity. The catch end 816 may be an alternative embodiment of the hook 416 from FIG. 4, catch end 604 of FIG. 6, and/or the tip 706 from FIG. 7. Catch end 816 is configured to align with/be positioned within an indentation 812 of a lip on the bottom leg 802*b* of clasp 800. The overlap of the catch end 816 and the indentation 812 of the clasp may serve to retain or release a chin strap therein to avoid unintentional release of the strap. A force applied to the catch end 816 may result in the bending, twisting, or extension of the catch end 816, similar to that shown for offset hook 702 in the side view C and/or isometric view B from FIG. 7.

The top loop 802 further includes a hinge 806, including a top hinge portion 804 extending into top leg 802*a* and a bottom hinge portion 808 extending into bottom leg 802*b*, formed at one end of the top loop 802, opposed in position to the catch end 816 about parallel axis 803 (e.g., the hinge 806 may be positioned on a first side of the clasp and the catch end 816 may be positioned on a second, opposite side of the clasp, with respect to the parallel axis 803). A width 804*w* of top hinge portion 804 of hinge 806 may be wider compared to a reduced width 808*w* of the bottom hinge portion 808 and may increase structural integrity of the connected top leg 802*a*. The bottom hinge portion 808 of the hinge 806 may have narrowed width 808*w*, compared to width 804*w* or other sections of clasp 800, which may allow the top loop/hinge to resiliently bend for fastening or releasing purposes, as explained above. In some examples, the width 808*w* may be the narrowest part of the hinge and may be the narrowest part of the first side of the clasp. The clasp at the width 808*w* may be referred to as a depression. The depression may define a flex point configured to flex in at least two axes. For example, as explained above, when exposed to a first range of forces at a first range of angles, the depression/flex point may flex outward and/or side-to-side in order to allow the clasp to resiliently bend.

The bottom leg 802*b* is shown as a substantially flat surface, but may instead have angled sloping on either side of the parallel axis 803 from the hinge 806 to the indentation 812. The indentation 812 may be formed from angled sloping along the bottom leg 802*b*, such as the S-shape curve shown in FIG. 8 starting at points 805 on either end of the indentation. Both S-shaped sloping sides may form the indentation 812, with their midpoints having angles configured to provide a balance between facilitating strap release (e.g., when the strap/clasp is subject to a first range of forces, as described above) and inhibiting release of the strap (e.g., when little or no outside forces/only gravity acts on the strap/clasp). The indentation 812 may have a first S-shape side with a midpoint slope having an angle 812*a* and a second S-shape side with midpoint slope having an angle 812*b*. Angle 812*a* and angle 812*b* each have slopes referenced from the horizontal axis 813, and are supplementary to an angle 916*a* of a first side of catch end 816 and an angle 916*b* of a second side of catch end 816, respectively, as pictured and described in FIG. 9. Increasing the midpoint S-shape angle degree on either side of the catch end 816 may increase the force needed to release the clasp, but may also act to retain the strap in position (e.g., to avoid accidental release of the strap when low or no forces are acting on the clasp). Angle 812*b* may be reduced compared to angle 812*a* to facilitate strap release while conversely increasing the angle respectively will inhibit strap release. Angle 812*a*, as shown, may be an 80 degree angle off the horizontal axis 813, but other angles are envisioned, such as angles between 10 and 85 degrees. Angle 812*b* may be a 45 degree angle off the horizontal axis 813, but other angles are envisioned, such as angles between 10 and 85 degrees.

Figure 9:
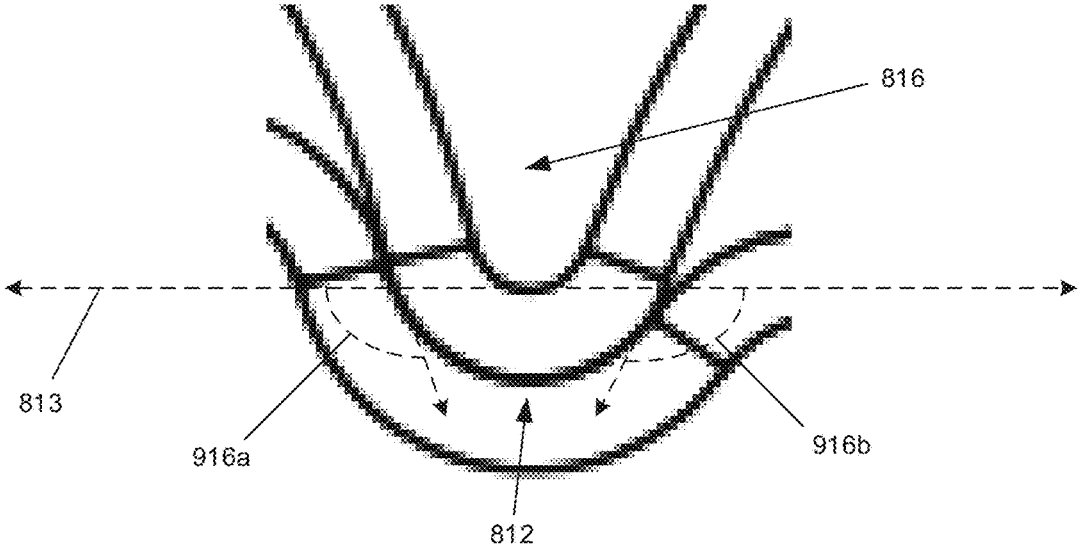
FIG. 9 shows an enlarged section of the clasp from FIG. 8

FIG. 9 is an exploded view of the catch end 816 and indentation 812 of clasp 800 from FIG. 8. Referencing FIGS. 8-9, the top leg 802*a* extends from the hinge 806 to catch end 816. The top leg 802*a*, shown as a relatively flat surface, may be variably sloped in the configuration from the hinge 806 side to the parallel axis 803 and from the parallel axis 803 to the catch end 816. The top leg 802*a* has points 807 where S-curves begin to form the catch end 816. Increased or decreased sloping along the S-curves are referenced from angles at their midpoints. Angle 916*a*, shown as 100 degrees, and angle 916*b*, shown as 135 degrees, of the catch end 816 are respectively supplementary to angle 812*a* and angle 812*b* of the indentation 812 along the horizontal axis 813. Increasing angles 916*a* and 916*b* may lower the forces needed to release the catch end 816 and decreasing the angles will increase the forces needed to release the catch end 816. The composition and/or widths of clasp 800 structures may change for structural integrity purposes on the bottom loop 820 and top loop 802, with respect to the catch end 816, bulge 814, top leg 802*a*, top hinge portion 804, bottom hinge portion 808, bottom leg 802*b*, and/or indentation 812. The actions by a user or other force that may maneuver the catch end 816 away from the indentation 812 will allow the strap to be fastened in place or removed in the top loop. Additionally, the clasp 800 has material properties that allow it to reform after being subjected to breakaway forces (e.g., bending) and may secure an attached item, such as a hat from FIGS. 1-3.

Thus, clasp 800 includes a top loop having a catch end on a first side of the clasp and a hinge on a second side of the clasp. The top loop may include an inner surface (e.g., the inner/bottom surface of top leg 802*a*) that includes a hinge-side portion, a middle portion, and a catch-end side portion. The hinge-side portion may curve with a first, smaller radius of curvature. The middle portion may be substantially flat and may extend along a horizontal axis of the clasp. The catch-end side portion may curve with a second, larger radius of curvature and may partially define the catch end. The catch end may include a tip that is positioned proximate a lip of a bottom loop of the clasp. The lip may be defined by an inner surface of a bottom leg of the top loop (e.g., bottom leg 802*b*) which is also a top portion of the bottom loop of the clasp. In the example shown in FIG. 8, the lip may include an indentation and the tip may be positioned in the indentation when the clasp is in an original/non-bent position (e.g., as shown in FIG. 8). When subject to bending forces (e.g., within the first range of forces described herein), the tip may release from the indentation, due to bending at the hinge. The release of the tip from the indentation may allow a strap positioned in the clasp to be released.

Figure 10:
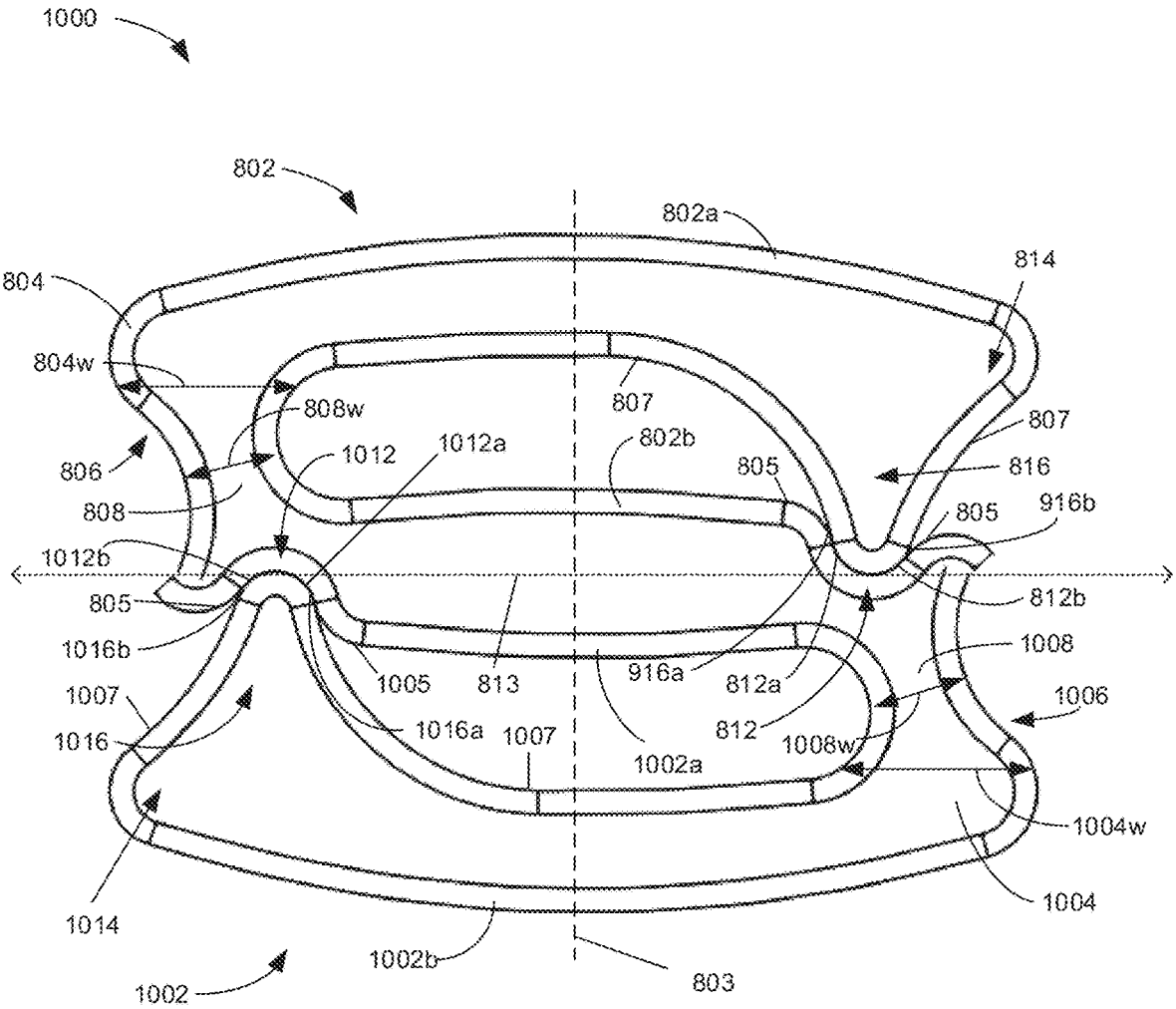
FIG. 10 shows a side view of an example clasp in accordance with one or more embodiments of disclosure.

FIG. 10 shows a side view of an example clasp 1000. Clasp 1000 is an embodiment of clasp 110 from FIGS. 1-3 and includes some top loop 802 components which are similar to clasp 800 from FIGS. 8-9. For instance, clasp 1000 includes catch end 816, angle 916*a*, angle 916*b*, bulge 814, top leg 802*a*, points 807, top leg 802*a*, top hinge portion 804, width 804*w*, hinge 806, bottom hinge portion 808, width 808*w*, bottom leg 802*b*, points 805, indentation 812, angle 812*a*, angle 812*b*, horizontal axis 813, and parallel axis 803 previously described in FIGS. 8-9. As shown, clasp 1000 includes the top loop 802 coupled to a bottom loop 1002 as defined relative to the horizontal axis 813 (e.g., the top loop 802 is positioned vertically above the horizontal axis 813 and the bottom loop 1002 is positioned vertically below horizontal axis 813), where the top loop 802 and bottom loop 1002 share a common middle portion (referred to herein as the bottom leg 802*b* of the top loop 802 and a top leg 1002*a* of the bottom loop 1002). In addition to these similarities, clasp 1000 includes a bottom loop 1002 having a catch end and a hinge, on opposite parallel and horizontal sides of the clasp from the hinge and catch end of the top loop, thereby forming a dual-sided breakaway clasp. The dual-sided breakaway clasp may allow replacement of the clasp if damage occurs (e.g., due to the clasp being removed from a corresponding strap). An axis of symmetry, along horizontal axis 813 and parallel axis 803, is shown whereby the rotation of the clasp may be a mirror image when rotated 180 degrees.

The bottom loop 1002 may have a bottom leg 1002*b* with a bottom catch end 1016 (also referred to as a hook) and a bulge 1014 on one side of the parallel axis 803. The bulge 1014 may facilitate user release of the clasp and/or add structural integrity. The bottom catch end 1016 may be an alternative embodiment of the hook 416 from FIG. 4, catch end 604 of FIG. 6, and/or the tip 706 from FIG. 7. Bottom catch end 1016 is configured to align with a top indentation 1012, both described later, on the top leg 1002*b* of clasp 1000. The overlap of the bottom catch end 1016 and the top indentation 1012 of the clasp may serve to retain or release a chin strap therein avoid unintentional release of the strap. A force applied to the bottom catch end 1016 may result in the bending, twisting, or extension of the bottom catch end

1016, similar to that shown for offset hook 702 in the side view C and/or isometric view B from FIG. 7.

The bottom loop 1002 further includes a bottom hinge 1006, including a bottom hinge portion 1004 extending into bottom leg 1002*b* and a top hinge portion 1008 extending into top leg 1002*a*, opposed in position to the bottom catch end 1016 about parallel axis 803 (e.g., the bottom hinge 1006 may be positioned on a first side of the clasp and the bottom catch end 1016 may be positioned on a second, opposite side of the clasp, with respect to parallel axis 803). A width 1004*w* of the bottom hinge portion 1004 of bottom hinge 1006 may be wider compared to a reduced width 1008*w* of the top hinge portion 1008 and may increase structural integrity connecting the bottom leg 1002*b*. The top hinge portion 1008 of bottom hinge 1006 may have a narrowed width 1008*w*, compared to width 1004*a* or other sections of clasp 1000, which may allow the bottom loop to resiliently bend at the bottom hinge when subject to a first range of forces, as described above. In some examples, the width 1008*w* may be the narrowest part of the bottom hinge on the second side of the clasp. The clasp at the width 1008*w* may be referred to as a depression. The depression may define a flex point configured to flex in at least two axes. For example, as explained above, when exposed to a first range of forces at a first range of angles, the depression/flex point may flex outward and/or side-to-side in order to allow the clasp to resiliently bend.

The top leg 1002*a* is shown as a substantially flat surface, but may instead have angled sloping on either side of parallel axis 803 from the hinge 1006 to the indentation 1012. Additional angled sloping may occur in association with the top indentation 1012 along the top leg 1002*b*, such as an S-shape starting at points 1005 on either end of the top indentation 1012. Both S-shaped sloping sides may form the top indentation 1012, with their midpoints having angles configured to facilitate or inhibit release of a strap. The top indentation 1012 may have a first S-shape side with midpoint slope having an angle 1012*a* and a second S-shape side with midpoint slope having an angle 1012*b*. Angle 1012*a* and angle 1012*b* each have slopes referenced from the horizontal axis 813, and are supplementary to an angle 1016*a* of a first side of catch end 1016 and an angle 1016*b* of a second side of catch end 1016 respectively (angle 1012*a*, angle 1012*b*, angle 1016*a*, and angle 1016*b* function as described and shown in FIGS. 8-9 as angle 812*a*, angle 812*b*, angle 916*a*, and 916*b* respectively hereto). Increasing the midpoint S-shape angle degree on either side of the catch end 1016 may increase the force needed to release the clasp, but may also act to retain the strap in position (e.g., to avoid accidental release of the strap when low or no forces are acting on the clasp). Angle 1012*b* may be reduced compared to angle 1012*a* to facilitate strap release while conversely, increasing the angle respectively will inhibit strap release. Angle 1012*a* may be an 80 degree angle off the horizontal axis 813, but other angles between are envisioned, such as angles between 10 and 85 degrees. Angle 1012*b* may be a 45 degree angle off the horizontal axis 813, but other angles are envisioned, such as angles between 10 and 85 degrees.

The composition and/or widths of the clasp 1000 structures may change for structural integrity purposes on the bottom loop 1002 with respect to the catch end 1016, bulge 1014, bottom leg 1002*b*, bottom hinge portion 1004, top hinge portion 1008, top leg 1002*a*, and/or indentation 1012. The bottom leg 1002*b*, shown as relatively flat surface, may be sloped downward in the configuration from the hinge side to the parallel axis 803 while another upward slope may be present from the parallel axis 803 to the catch end 1016. The bottom leg 1002*b* has points 1007 where S-curves begin to form the catch end 1016. Increased or decreased sloping along the S-curve are referenced from angles at their midpoints. Angle 1012*a* and angle 1012*b* of the indentation 1012 are supplementary to angle 1016*a* and angle 1016*b* on respective sides of the catch end 1016.

The actions by a user or other force that may maneuver the catch end 1016 away from the indentation 1012 will allow the strap to be fastened in place or removed in the bottom loop 1002. Additionally, the clasp 1000 has material properties that allow it to reform after being subjected to breakaway forces (e.g., bending) and may secure an attached item, such as a hat from FIGS. 1-3. An axis of symmetry about the parallel axis 803 and the horizontal axis 813 is shown whereby the clasp 1000 may be reoriented 180 degrees and still function as intended (e.g., the clasp may be positioned on the strap in either orientation). Other envisioned embodiments may facilitate different tensions for a breakaway clasp by changing angles of the indentation and/or catch end as well as varying the width of the hinge on the top loop 802 or bottom loop 1002. Another advantage of clasp 1000 is there is no permanently mounted clasp allowing the clasp to be replaced and/or potentially allowing the replacement of a strap to reuse with the clasp.

Figure 11:
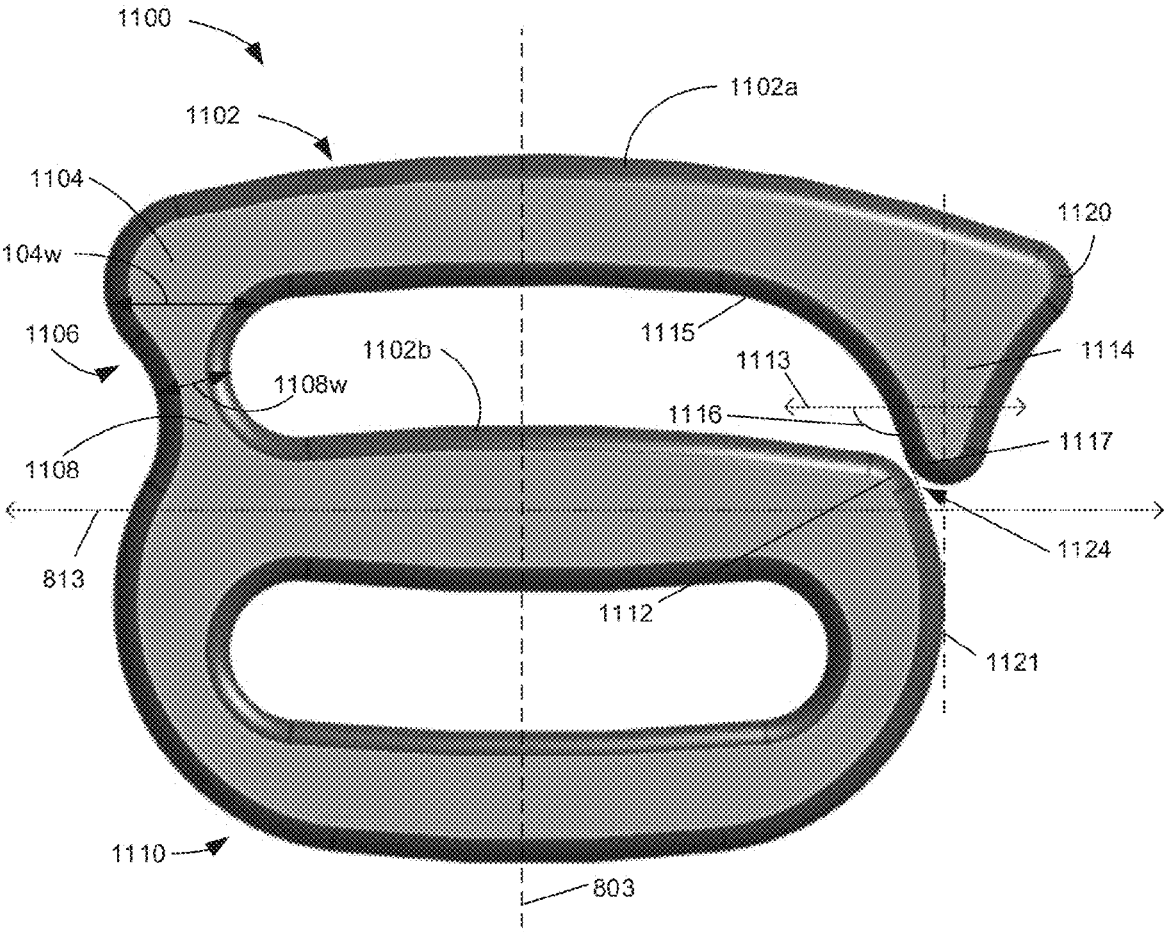
FIG. 11 shows a side view of an example clasp in accordance with one or more embodiments of disclosure.

FIG. 11 shows a side view of an example clasp 1100. Clasp 1100 is an embodiment of clasp 110 from FIGS. 1-3. Clasp 1100 has a catch end 1114 that may be an alternative embodiment of the hook 416 from FIG. 4, catch end 604 of FIG. 6, and/or the tip 706 from FIG. 7. As shown, clasp 1100 includes a top loop 1102 coupled to a bottom loop 1110 as defined relative to the horizontal axis 813 (e.g., the top loop 1102 is positioned vertically above the horizontal axis 813 and the bottom loop 1110 is positioned vertically below the horizontal axis 813), where the top loop 1102 and bottom loop 1110 share a common middle portion (referred to herein as a bottom leg 1002*b* of the top loop 1102).

As shown in FIG. 11, on one side of the parallel axis 803, clasp 1100 includes a catch end 1114 as an extension of a top leg 1102*a* of a top loop 1102. The catch end 1114 on clasp 1100 may extend over a lip 1112 on the bottom leg 1102*b* on the same side of the parallel axis 803 thereby creating a gap 1124 between the lip 1112 and a bottom edge 1117 of the catch end 1114. The width of the gap 1124 (e.g., 1-5 mm) may be selected based on a strap width and/or thickness of a strap configured to be positioned within the clasp (e.g., a larger strap width or thickness may not slide out through gap as easily as a narrow/thinner strap). The top leg 1102*a*, shown as a relatively flat surface, may have angled slopes on either side of the parallel axis 803. The catch end 1114 may have gradual S-curve sloping relative to a horizontal axis 1113 (parallel to horizontal axis 813) on the lower sections of top end 1102*a* starting at point 1115. The middle section of the S-curve of the catch end 1114 may have an angle 1116, shown as 110 degrees (though other angles are possible, such as from 45 to 135 degrees), configured to retain a strap and/or release a strap under certain tensions. The angle 1116 may be reduced to increase forces needed to release a strap or increased to decrease forces needed to release a strap. The width of the gap 1124 and angle 1116 of the S-curve of the catch end 1114 may be configured in the manufacturing process to work together to release at a configured tension. A bulge 1120 may be present on the catch end 1114 that may include gripping material or increased size to assist in user release and/or for structural integrity. The bulge 1120 and catch end 1114 configuration may extend vertically beyond a corresponding vertical edge 1121 (parallel to vertical axis 803) of the bottom loop 1110, and in coordination with manufacturing processes (e.g., material properties, width of the gap 1124, angle 1116) prevent the strap from slipping out (e.g., due to gravity alone) through the gap 1124 and additionally allow easy release.

On the other side of the parallel axis 803, a hinge 1106 may be formed, configured of an upper hinge portion 1104 and a lower hinge portion 1108. The upper hinge portion 1104, which is an extension of the top leg 1102*a*, may have a width 1104*w* that is greater than the lower hinge portion 1108 providing structural integrity for the top leg 1102*a*. The lower hinge portion 1108, which is an extension of the bottom leg 1102*b*, may have a reduced width 1108*w*, compared to the upper hinge portion 1104 and other clasp 1100 structures, that allows bending and twisting movement of the upper leg 1102*a* and catch end 1114 when a force is applied, similar to that shown for offset hook 702 in the side view C and/or isometric view B from FIG. 7. Additionally, the clasp 1100 has material properties that allow it to reform after being subjected to breakaway forces (e.g., bending) and may secure an attached item, such as a hat from FIGS. 1-3. In some examples, the width 1108*w* may be the narrowest part of the hinge and/or clasp on the second side of the clasp. The clasp at the width 1108*w* may be referred to as a depression. The depression may define a flex point configured to flex in at least two axes. For example, as explained above, when exposed to a first range of forces at a first range of angles, the depression/flex point may flex outward and/or side-to-side in order to allow the clasp to resiliently bend.

The bottom leg 1102*b* extends from the lower hinge portion 1102*b* to the lip 1112. Bottom leg 1102*b* is shown as a relatively flat surface, but sloping may occur on either side of the parallel axis 803, configured for strap retention or release. The composition and/or widths of the catch end 1114, top leg 1102*a*, hinge 1106, and lower leg 1102*b* of the top loop 1102 as well as the bottom loop 1110 may vary to allow or deter movements of structures of clasp 1100 under certain forces while retaining original shape when forces are withdrawn.

Thus, clasp 1100 includes a top loop having a catch end on a first side of the clasp and a hinge on a second side of the clasp. The top loop may include an inner surface (e.g., the inner/bottom surface of top leg 1102*a*) that includes a hinge-side portion, a middle portion, and a catch-end side portion. The hinge-side portion may curve with a first, smaller radius of curvature. The middle portion may be substantially flat and may extend along a horizontal axis of the clasp. The catch-end side portion may curve with a second, larger radius of curvature and may partially define the catch end. The catch end may include a tip that is positioned proximate a lip of a bottom loop of the clasp. The lip may be defined by an inner surface of a bottom leg of the top loop (e.g., bottom leg 1102*b*) which is also a top portion of the bottom loop of the clasp. In the example shown in FIG. 11, the tip may be spaced apart from the lip by a first amount along a horizontal axis of the clasp when the clasp is in an original/non-bent position (e.g., as shown in FIG. 11). When subject to bending forces (e.g., within the first range of forces described herein), the tip may move upward relative to the lip, due to bending at the hinge, thereby increasing the size of the gap and allowing a strap positioned in the clasp to be released.

While not shown in FIG. 11, it is to be appreciated that in some examples, the clasp 1100 may be configured as a dual-breakaway clasp, thereby including a second catch end and a second hinge on the bottom loop. In such an example, the second catch end and the second hinge may be configured similarly to the catch end and hinge described above for clasp 1100, with the second catch end positioned on the first side of the clasp (e.g., on the same side as the hinge 1106) and the second hinge positioned on the second side of the clasp (e.g., on the same side as the catch end 1114).

FIGS. 1-11 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The description of embodiments has been presented for purposes of illustration and description. Suitable modifications and variations to the embodiments may be performed in light of the above description. The described example headwear are exemplary in nature, and may include additional elements and/or omit elements. The subject matter of the present disclosure includes all novel and non-obvious combinations and sub-combinations of the various structures and configurations, and other features, functions, and/or properties disclosed.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects. The following claims particularly point out subject matter from the above disclosure that is regarded as novel and non-obvious.

The invention claimed is:

1. A clasp, comprising:

a top loop having a catch end at a first side of the clasp, the top loop including a top portion that extends from a second side of the clasp to the first side of the clasp along a horizontal axis of the clasp, the catch end extending from the top portion along an s-shaped curve to form a tip of the catch end, the top loop further including a first side portion opposite the catch end, wherein the first side portion has a first radius of curvature and the catch end has a second radius of curvature, larger than the first radius of curvature;

a bottom loop coupled to the top loop via a common middle portion, a top surface of the common middle portion having a lip; and a depression at the top loop on the second side of the clasp, a thinnest part of the top loop at the second side of the clasp being formed by the depression and defining a hinge configured to resiliently bend when exposed to a first range of forces at a first range of angles.

2. The clasp of claim 1, wherein the tip of the catch end is spaced apart from the lip by a gap along the horizontal axis of the clasp.

3. The clasp of claim 2, wherein the tip of the catch end overlaps the lip along a vertical axis of the clasp.

4. The clasp of claim 1, wherein the catch end is a first catch end and the depression is a first depression, and wherein the bottom loop includes a second catch end on the second side of the clasp and a second depression on the first side of the clasp.

5. The clasp of claim 1, wherein the depression is formed on an outer surface of the top loop at the second side of the clasp.

6. The clasp of claim 1, wherein the bottom loop is a closed loop.

7. The clasp of claim 1, wherein:

the top loop includes the first top portion, the catch end, the first side portion opposite the catch end, and the common middle portion;

the bottom loop includes the common middle portion, a second side portion, a third side portion opposite the second side portion, and a second bottom portion;

the first side of the clasp includes the catch end and the third side portion; and the second side of clasp includes the first side portion and the second side portion.

8. The clasp of claim 7, wherein at least part of the top surface of the middle portion has a substantially linear declination.

9. The clasp of claim 7, wherein the thinnest part of the second side at the top loop is located on the first side portion, such that the first side portion is thinner than the second side portion.

10. A clasp, comprising:

a top loop having a first catch end at a first side of the clasp;

a bottom loop coupled to the top loop, the bottom loop having a second catch end at a second side of the clasp, opposite the first side; and a first depression at the top loop on the second side of the clasp, a thinnest part of the top loop at the second side of the clasp being formed by the first depression, the first depression defining a flex point configured to flex in at least two axes.

11. The clasp of claim 10, further comprising a second depression at the bottom loop on the first side of the clasp, a thinnest part of the bottom loop at the first side of the clasp being formed by the second depression.

12. The clasp of claim 10, wherein the top loop includes a top portion that extends from the second side of the clasp to the first side of the clasp along a horizontal axis, the first catch end extending from the top portion along an s-shaped curve to form a first tip of the first catch end, and wherein the bottom loop has a first lip.

13. The clasp of claim 12, wherein the first tip of the catch end is spaced apart from the first lip by a gap along the horizontal axis.

14. The clasp of claim 12, wherein the first lip includes an indentation, and wherein the first tip of the first catch end is configured to be positioned in the indentation when the clasp is in an original, non-bent position.

15. A clasp, comprising:

a top loop having a top inner surface that includes a first side portion with a first radius of curvature, a substantially straight middle portion extending across a horizontal axis of the clasp, and a second side portion with a second radius of curvature partially defining a catch end, the catch end including a tip, the first side portion on a first side of the clasp, the second side portion on a second side of the clasp, and the second radius of curvature being larger than the first radius of curvature;

a bottom loop coupled to the top loop via a common middle portion, the tip of the catch end positioned proximate a lip of the common middle portion; and a depression at the first side of the clasp, a thinnest part of the top loop at the first side of the clasp being formed by the depression and defining a hinge configured to resiliently bend when exposed to a first range of forces at a first range of angles.

16. The clasp of claim 15, wherein the lip includes an indentation and the tip is positioned in the indentation when the clasp is in an original, non-bent position.

17. The clasp of claim 15, wherein the tip is spaced apart from the lip by a gap along the horizontal axis.

18. The clasp of claim 17, wherein the tip overlaps the lip along a vertical axis, perpendicular to the horizontal axis.

19. The clasp of claim 15, wherein the hinge is configured to break when exposed to a second range of forces at the first range of angles.

* * * * *